US011296464B2

(12) United States Patent
Evans et al.

(10) Patent No.: US 11,296,464 B2
(45) Date of Patent: Apr. 5, 2022

(54) IMPEDANCE CONTROL CONNECTOR

(71) Applicant: TE Connectivity Services GmbH, Schaffhausen (CH)

(72) Inventors: Nicholas Lee Evans, Harrisburg, PA (US); Nathan William Swanger, Dillsburg, PA (US); Neil Franklin Schroll, Mount Joy, PA (US); John Wesley Hall, Hummelstown, PA (US); Bin Lin, Hummelstown, PA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/791,592

(22) Filed: Feb. 14, 2020

(65) Prior Publication Data

US 2021/0257786 A1 Aug. 19, 2021

(51) Int. Cl.

| | |
|---|---|
| ***H01R 13/6476*** | (2011.01) |
| ***H01R 13/11*** | (2006.01) |
| ***H01R 13/506*** | (2006.01) |
| ***H01R 13/6581*** | (2011.01) |

(52) U.S. Cl.

CPC ..... *H01R 13/6476* (2013.01); *H01R 13/11* (2013.01); *H01R 13/506* (2013.01); *H01R 13/6581* (2013.01)

(58) Field of Classification Search

CPC ..... H01R 13/6592; H01R 13/6593; H01R 13/6272; H01R 13/6275; H01R 13/436–4368; H01R 13/6476; H01R 13/11; H01R 13/506; H01R 13/6581

USPC ..... 439/883, 607.41–607.52, 607.27, 352, 439/489, 752

See application file for complete search history.

(56) References Cited

U.S. PATENT DOCUMENTS 3,577,117 A * 5/1971 Bruetsch ..... H01R 31/02 439/787
4,634,204 A * 1/1987 Detter ..... H01R 13/641 439/347
5,259,768 A * 11/1993 Brunker ..... H01R 13/6474 439/60

(Continued)

FOREIGN PATENT DOCUMENTS

JP 6551764 A 7/2019

OTHER PUBLICATIONS

International Search Report, International Application No. PCT/IB2021/051237, International Filing Date Feb. 15, 2021.

*Primary Examiner* — Gary F Paumen

(57) ABSTRACT

A connector assembly which controls impedance. The connector assembly includes a first metallic outer housing and a second metallic outer housing. The second metallic housing has a conductor receiving portion. A rib is formed in the conductor receiving portion, the rib extends in a direction which is parallel to a longitudinal axis of the second metallic outer shell. A terminal positioned in the connector assembly has a conductor receiving section and a mating terminal receiving section. The mating terminal receiving section has a lead-in portion and securing projections. At least one longitudinally extending opening is positioned about the circumference of the mating terminal receiving section, the opening reduces the cross section of the terminal. The opening provides impedance tuning to allow for a defined pitch of the terminal to be maintained without an impedance drop because of the close proximity of the terminal to an adjacent terminal.

7 Claims, 11 Drawing Sheets

(56) References Cited

U.S. PATENT DOCUMENTS 5,309,630 A * 5/1994 Brunker ..... H01R 12/83 29/842
5,459,643 A * 10/1995 Siemon ..... H04Q 1/142 361/746
5,628,648 A * 5/1997 Higgins, Jr. ..... H01R 13/6272 439/489
5,888,096 A 3/1999 Soes et al.
6,045,388 A * 4/2000 Higgins ..... H01R 13/6273 439/352
6,435,895 B1 * 8/2002 Fink ..... H01R 13/6272 439/352
7,025,617 B2 * 4/2006 Regnier ..... H01R 13/41 439/329
7,909,638 B2 * 3/2011 Seo ..... H01R 13/6272 439/489
8,210,864 B1 * 7/2012 Hernandez ..... H01R 13/4362 439/352
8,678,846 B2 * 3/2014 Hitchcock ..... H01R 13/641 439/352
9,281,598 B2 3/2016 Zebhauser et al.
9,941,608 B2 4/2018 Zebhauser et al.
10,135,172 B1 * 11/2018 Foltz ..... H01R 13/6272
10,249,995 B2 4/2019 Zebhauser et al.
10,347,397 B2 7/2019 Armbrecht et al.
10,389,062 B2 8/2019 Zebhauser et al.
10,396,472 B2 8/2019 Baldauf et al.
10,553,977 B2 2/2020 Pemwieser et al.
10,594,104 B2 * 3/2020 Hofling ..... H01R 43/05
2002/0022407 A1 * 2/2002 Niitsu ..... H01R 13/658 439/676
2002/0050388 A1 * 5/2002 Simpson ..... H01R 13/24 174/88 C
2003/0224632 A1 * 12/2003 Regnier ..... H01R 13/41 439/79
2004/0248453 A1 * 12/2004 McLauchlan ..... H01R 13/6272 439/352
2005/0221673 A1 * 10/2005 Myer ..... H01R 13/6594 439/607.01
2008/0139035 A1 * 6/2008 Kim ..... H01R 13/6272 439/352
2008/0305694 A1 * 12/2008 Takahashi ..... H01R 13/4362 439/752
2010/0062660 A1 * 3/2010 Itou ..... H01R 13/4362 439/752
2015/0132994 A1 5/2015 Zebhauser et al.
2015/0147901 A1 * 5/2015 Wu ..... H01R 13/639 439/357
2017/0040087 A1 2/2017 Armbrecht et al.
2018/0366856 A1 12/2018 Pemwieser et al.
2019/0058296 A1 2/2019 Bredbeck
2019/0148865 A1 * 5/2019 Zebhauser ..... H01R 9/0518 439/825

* cited by examiner

IMPEDANCE CONTROL CONNECTOR

FIELD OF THE INVENTION

The present invention is directed to an impedance control connector. In particular, the invention is directed to an impedance control connector which provides a stable transition zone impedance for twisted pair connector with long untwisted portion.

BACKGROUND OF THE INVENTION

Maintaining signal integrity in communications is always desired. Factors that affect signal integrity include cable design and the process that is used to terminate or attach a cable. Cables are typically made of at least one plated center conductor covered by a dielectric and a braid and/or foil shield protector with an overall non-conductive jacket. The termination of the braid onto a device, such as a printed circuit board (PCB) or a connector, can significantly affect cable performance.

Various methods are known to terminate shield connectors, including soldering the end of the wire onto a PCB/connector termination, laser terminating parallel gap resistance welding. Another common method of termination is to use a ferrule. One significant problem with a ferrule is that crimping the wire to apply the ferrule tends to crush the cable dielectric. Another problem with existing methods of terminating a braid is that they can tend to rearrange the placement of the differential pair within the cable jacket. Both problems can affect impedance and other electrical parameters, which affect signal integrity.

In addition, due to the decreased size and increased function of these connectors, it is difficult to have effective connector position assurance devices and terminal position assurance devices which meet the force requirements for different industries, such as, the automotive industry.

It would be, therefore, beneficial to provide an electrical connector which controls impedance and which does not damage or rearrange the conductors of the cable. It would be beneficial to provide an electrical connector in which a visible and mechanical indication is provided that the terminals are properly positioned and secured in the housing.

SUMMARY OF THE INVENTION

An embodiment is directed to a terminal for terminating a shielded cable in a connector assembly. The terminal has a conductor receiving section and a mating terminal receiving section. The mating terminal receiving section has a lead-in portion and securing projections. At least one longitudinally extending opening is positioned about the circumference of the mating terminal receiving section, the opening reduces the cross section of the terminal. The opening provides impedance tuning to allow for a defined pitch of the terminal to be maintained without an impedance drop because of the close proximity of the terminal to an adjacent terminal.

An embodiment is directed to a connector assembly which controls impedance. The connector assembly includes a first metallic outer housing and a second metallic outer housing. The second metallic housing has a conductor receiving portion. A rib is formed in the conductor receiving portion, the rib extends in a direction which is parallel to a longitudinal axis of the second metallic outer shell.

An embodiment is directed to a connector housing assembly. The housing assembly has a mating end and an oppositely facing conductor receiving end. A top wall, a bottom wall and side walls extend between the mating end and the conductor receiving end. A connector receiving passage extends between the mating end and the conductor receiving end. An impedance controlled connector assembly is positioned in the connector receiving passage. The connector assembly has a first metallic outer housing or shell and a second metallic outer housing or shell. The first metallic outer shell has a stamped and formed recess which extends about the circumference of the first metallic outer shell, the recess provides controlled impedance of the first metallic outer shell in the area of the recess. A latch having an engagement projection extends from the top wall, the engagement projection has a mating engagement surface. A connector position assurance receiving recess extends from the top wall. A connector position assurance device is positioned in the connector position assurance receiving recess. The connector position assurance device has a base portion and a resiliently deformable beam which extends from the base portion. A lockout projection engagement member extends from the beam. The lockout projection engagement member has a cam or sloped surface configured to cooperate with the mating engagement surface of the engagement projection of the latch.

An embodiment is directed to a connector housing assembly. The housing assembly has a mating end and an oppositely facing conductor receiving end. A top wall, a bottom wall and side walls extend between the mating end and the conductor receiving end. A connector receiving passage extends between the mating end and the conductor receiving end. An impedance controlled connector assembly is positioned in the connector receiving passage. The connector assembly has a first metallic outer housing or shell and a second metallic outer housing or shell. The first metallic outer shell has a stamped and formed recess which extends about the circumference of the first metallic outer shell, the recess provides controlled impedance of the first metallic outer shell in the area of the recess. A terminal position assurance receiving recess extending from a side wall. A terminal position assurance device is positioned in the terminal position assurance receiving recess. The terminal position assurance device has a base with a first surface and an oppositely facing second surface. A first terminal engagement section and second terminal engagement arms extend from the first surface in a direction away from the second surface.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
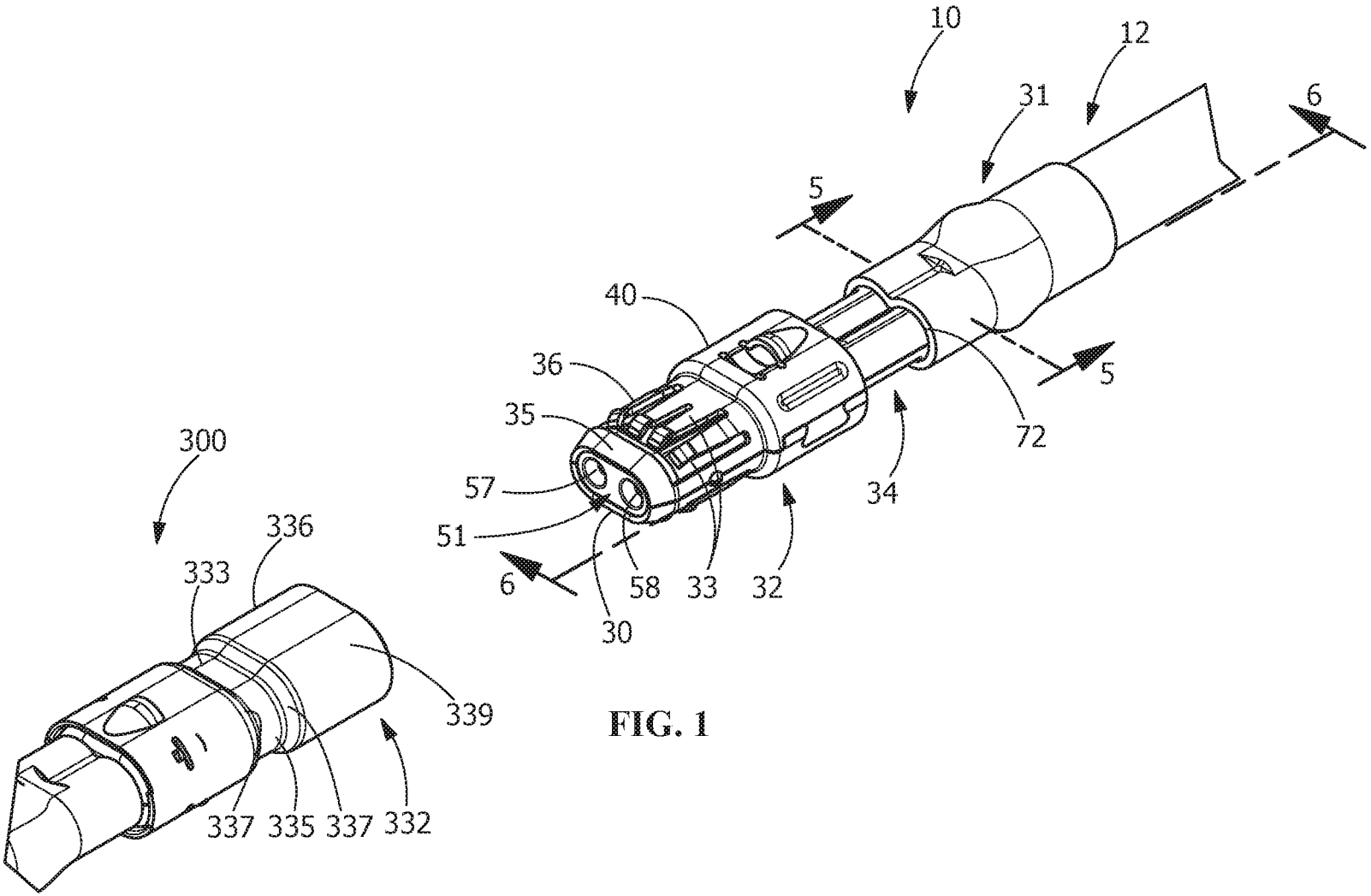
FIG. 1 is a perspective view of an electrical connector assembly of the present invention fully assembled on a cable with a mating connector assembly positioned proximate to and in line with the electrical connector assembly.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 5:
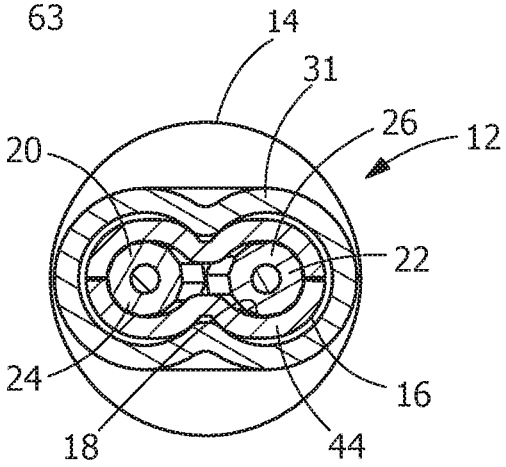
FIG. 5 is a cross-sectional view of the electrical connector taken along line 5-5 of FIG. 1.
Figure 6:
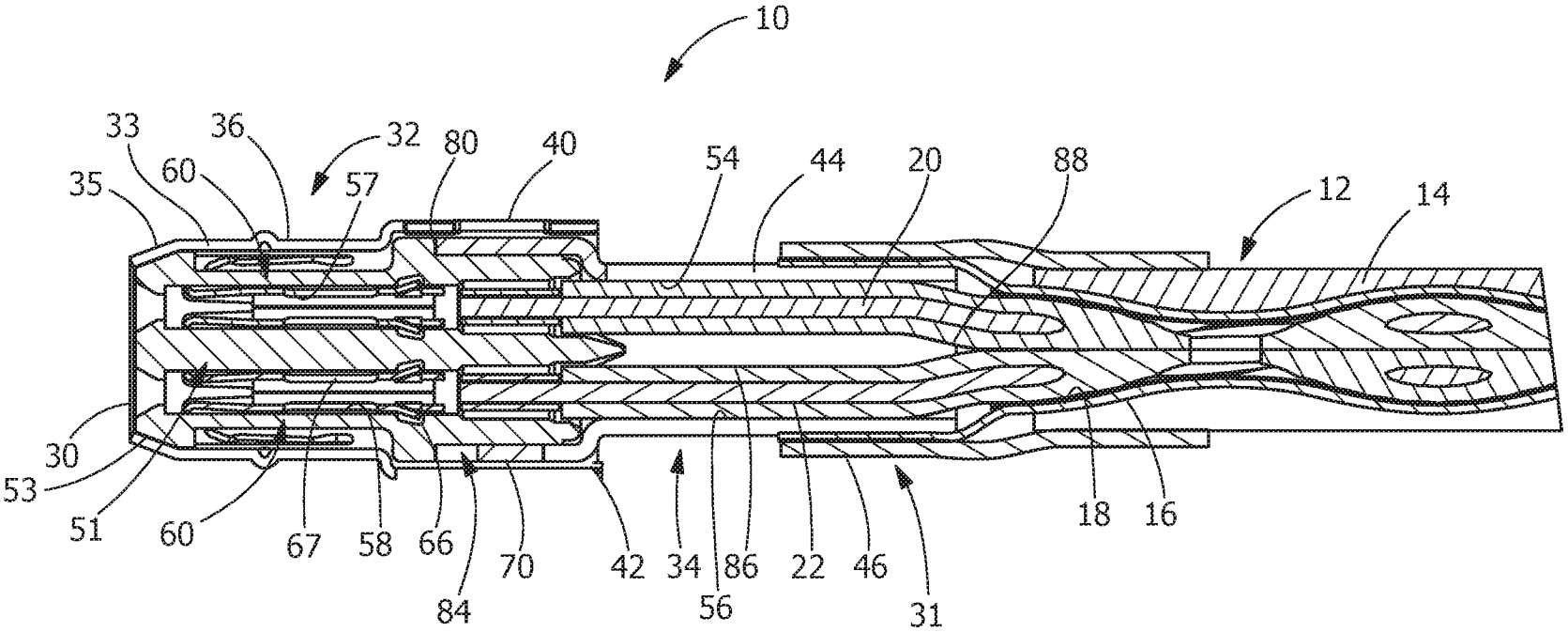
FIG. 6 is a cross sectional view of the electrical connector and cable taken along line 6-6 of FIG. 1.
Figure 7:
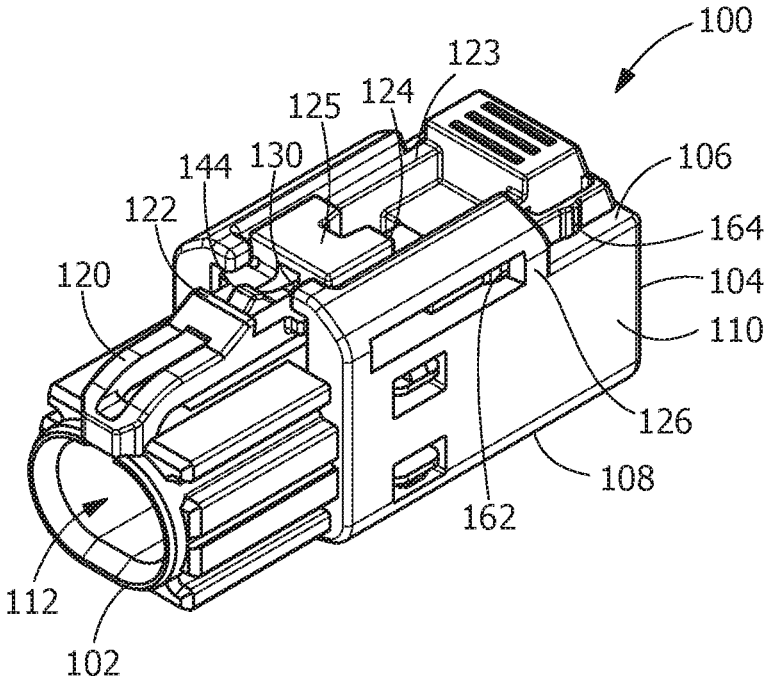
FIG. 7 is a front perspective view of a housing assembly into which the electrical connector is inserted, a connector position assurance member is shown in a first or open position.

As shown in FIGS. 1 and 6, an electrical connector 10 is electrically and mechanically connected to a cable 12. The cable 12 can transfer data between and among storage devices, switches, routers, printed circuit boards (PCBs), analog to digital converters, connectors, and other devices. In various embodiments, the cable 12 can support data transfer rates of 100 Mbps and higher. In some embodiments, the cable 12 can support data transfer rates of approximately 4.25 Gbps to approximately 25 Gbps. The cable 12 also can be used with data transfer rates above or below these exemplary rates. As shown in FIG. 5, the cable 12 has a cable jacket 14, a braided shield 16, a metalized foil 18 and two center conductors 20, 22. The conductors 20, 22 are spaced from each other and extend substantially parallel to each other. The conductors 20, 22 are surrounded by the braided metal shield 16, such as, but not limited to braided copper shielding. The center conductors 20, 22 may also be surrounded by individual dielectrics 24, 26. Terminals 60 (FIGS. 2, 4 and 6) are electrically connected to the exposed ends of the conductors 20, 22 of the cable 12.

Figure 2:
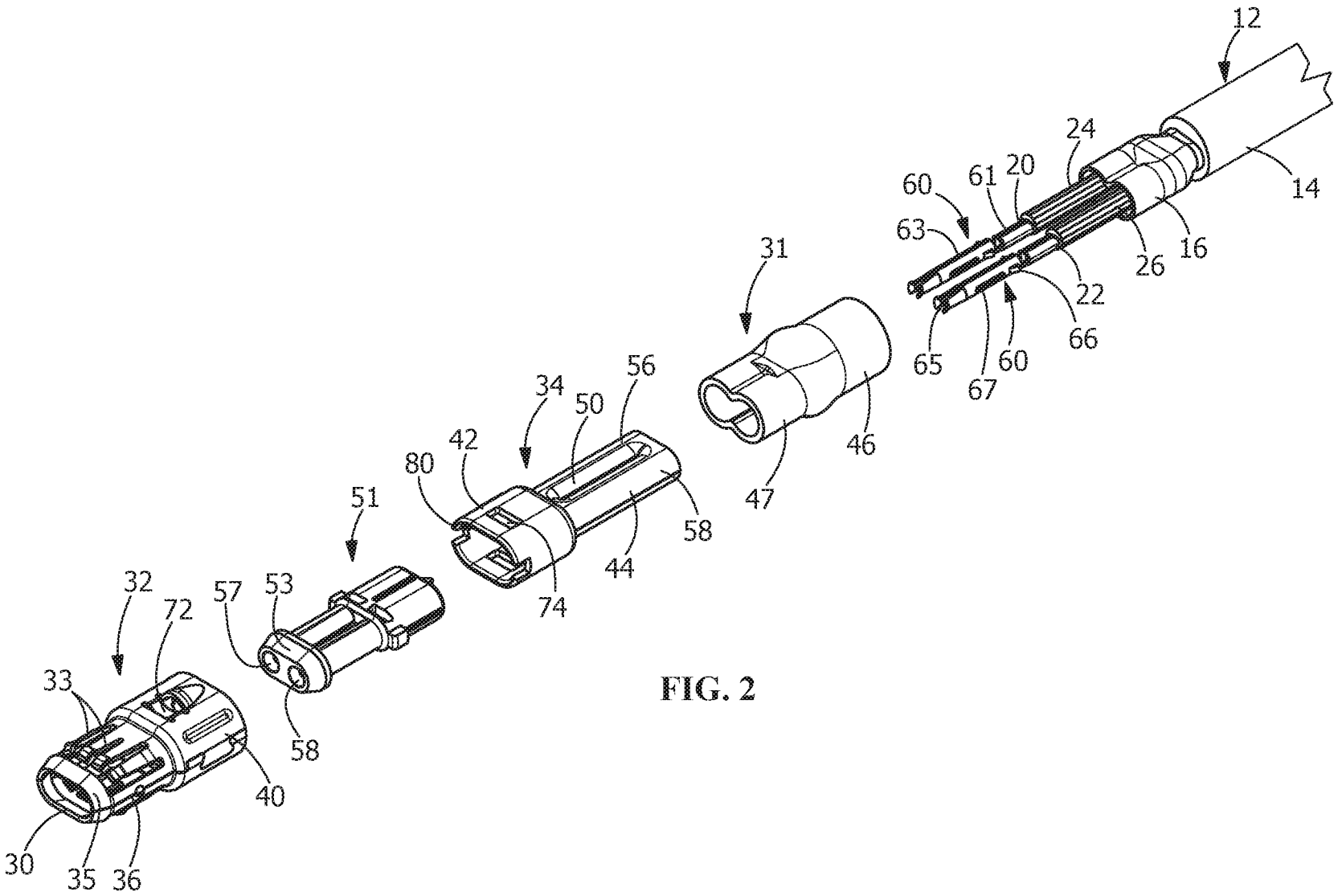
FIG. 2 is an exploded perspective view of the electrical connector of FIG. 1.

As shown in FIGS. 2 and 6, an end of the cable 12 has the cable jacket 14 removed. The dielectrics 24, 26 of the conductors 20, 22 are also removed, thereby exposing a portion of the conductors 20, 22.

With the connector 10 properly assembled the connector is mated to a mating connector 300. As illustrative mating connector 300, as shown in FIG. 1, has a metallic outer shell 332 which has a connector receiving portion 336 for receiving the electrical connector 10 therein. The outer shell 332 has a stamped and formed band or recess 333 which extends about the circumference of the outer shell 332. Alternatively, the recess 333 may be formed by other processes, such as, but not limited to, diecasting or screw machining. The recess 333 has a bottom wall 335 and transition or sloped walls 337 which extend from an outside surface 339 of the outer shell 332 to the bottom wall 335 of the recess 333. Although the thickness of the material of the first outer shell 332 is difficult to vary with a stamped and formed part, the use of the recess 333 allows controlled impedance of the first outer shell 332 of the connector 300 in this area. The impedance may be tuned to the desired level by varying the depth of the recess 333 when the outer shell 332 is manufactured.

Referring to FIGS. 1 and 6, the electrical connector 10 has a first metallic outer shell 32, a second metallic outer shell 34 and a third metallic outer shell 31. The first metallic outer shell 32 has a mating connector receiving portion 36 and a second metallic outer shell receiving portion 40. The second metallic outer shell 34 has a first metallic outer shell receiving portion 42 and a conductor receiving portion 44.

As shown in FIGS. 1, 2 and 6, the mating connector receiving portion 36 of the first metallic outer shell 32 has resilient contact arms 33 which extend from the second metallic outer shell receiving portion 40 to an electrically conductive protection member or portion 35 of the mating connector receiving portion 36. The protection member 35 is positioned proximate to and extends from a mating end 30 of the first metallic outer shell 32. The protection member 35 surrounds a mating end 53 of a dielectric housing 51, but does not cover the terminal receiving openings 57, 58 of the housing 51. The protection member 35 acts as a lead-in surface when a mating connector 300 is mated to the connector 10. The resilient contact arms 33 engage the connector receiving portion 336 of the mating connector 300 to position and maintain the mating connector 300 and the connector 10 is electrical and mechanical engagement.

Figure 3:
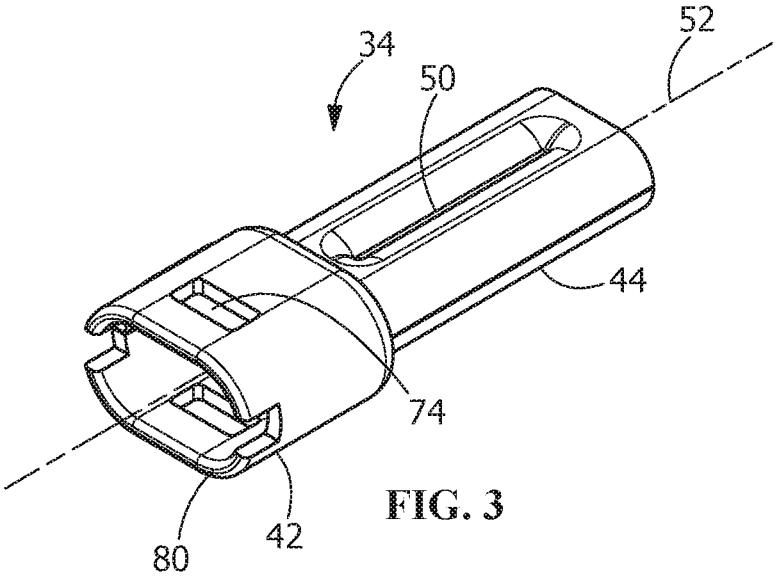
FIG. 3 is an enlarged perspective view of an outer shell of the electrical connector shown in FIG. 2.
Figure 8:
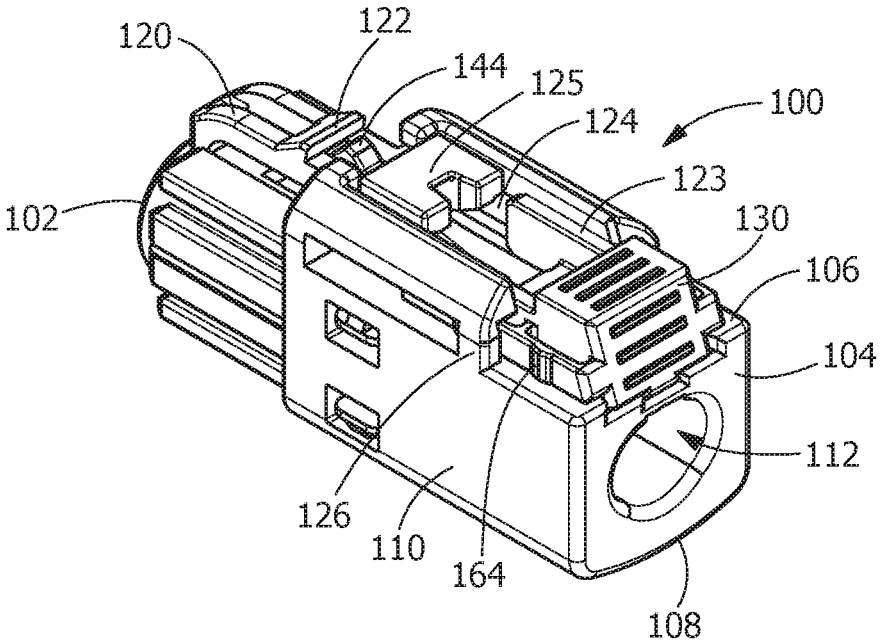
FIG. 8 is a back perspective view of the housing of FIG. 7.

As shown in FIG. 3, a rib 50 is stamped or coined in the conductor receiving portion 44 of the outer shell 34. The rib 50 extends in a direction which is substantially parallel to a longitudinal axis 52 of the outer shell 34. As shown in FIG. 5, the conductor receiving portion 44 has a FIG. 8 configuration when viewed in cross section.

The rib 50 divides the conductor receiving portion 44 into two conductor receiving passages 54, 56. The conductor receiving passages 54, 56 are dimensioned to allow for the insertion of the terminals 60 therethrough.

Figure 4:
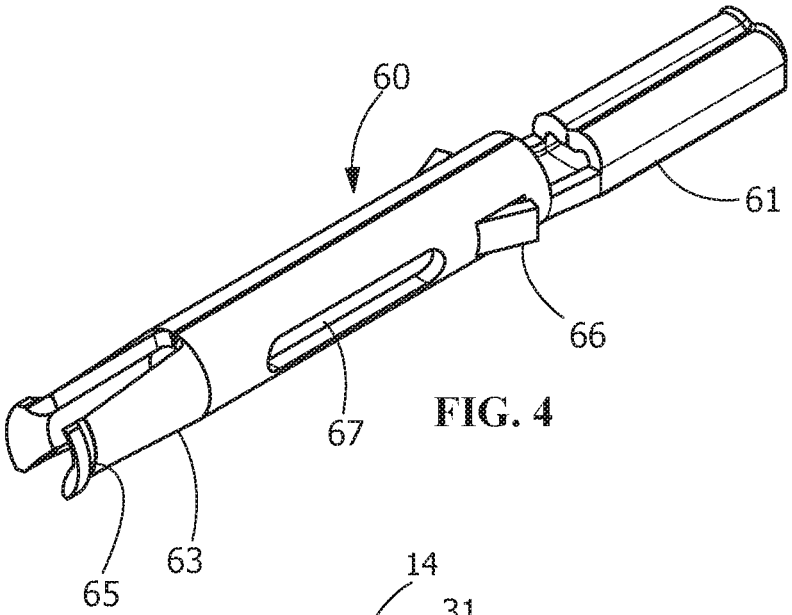
FIG. 4 is an enlarged perspective view of a contact of the electrical connector shown in FIG. 2.

As shown in FIG. 4, the terminals 60 include conductor receiving sections 61 and mating terminal receiving sections 63. The mating terminal receiving sections 63 have a lead-in portion 65 and securing barbs or projections 66. Longitudinally extending openings 67 are positioned about the circumference of the mating terminal receiving sections 63. In the embodiment shown, two openings 67 are provided and are positioned approximately 180 degrees from each other. The openings 67 reduce the cross section area of the terminals 60 and reduce the inductive coupling between adjacent terminals 60, resulting in an increased impedance. By varying the dimensions, configurations and location of the openings 67, the impedance of the terminals 60 and the connector 10 may be tuned without the need to make alterations to other parts of the connector 10. This allows for a defined pitch or diameter of the terminals 60 to be maintained without an impedance drop because of the close proximity of the terminals 60 to each other.

When assembled, as shown in FIG. 6, an end 80 of first metallic outer shell receiving portion 42 of the second metallic outer shell 34 is positioned within the second metallic outer shell receiving portion 40 of the first metallic outer shell 32. One or more latches 72 of the first metallic outer shell 32 cooperate with one or more openings 74 of the second metallic outer shell 34 to secure the second metallic outer shell 34 to the first metallic outer shell 32. Alternatively, the second metallic outer shell 34 is secured to the first metallic outer shell 32 by adhesive, or other know methods of attachment, such as welding.

As shown in FIGS. 2 and 6, the terminals 60 of the electrical connector 10 are terminated to ends of the conductors 20, 22 of the cable 12. Conductor receiving sections 61 of the terminals 60 are crimped to the conductors 20, 22. However, other methods of terminating the terminals 60 to the conductors 20, 22 may be used. In the illustrative embodiment shown, the terminals 60 are female terminals with mating terminal receiving sections 63 extending from the conductor receiving sections 61. However, other configurations of terminals, including, but not limited to, male pin terminals, may be used.

With the terminals 60 properly terminated to the conductors 20, 22, the terminals 60 are inserted through the cable securing portion 46. The terminals 60 are then inserted through the conductor receiving passages 54, 56 of the conductor receiving portion 44 and into terminal receiving openings 57, 58 of the dielectric housing 51 positioned in the first outer shell 32. Barbs or projections 66 of the terminals 60 engage and displace material in the terminal receiving openings 57, 58, thereby retaining the terminals 60 in the terminal receiving openings 57, 58.

With the terminals 60 properly secured, the conductors 20, 22 are positioned in the conductor receiving portion 44 of the second metallic outer shell 34, with the exposed portion 23 (FIG. 6) of one conductor 20 positioned in the first conductor receiving passage 54 and the conductor 22 positioned in the second conductor receiving passages 56.

As shown in FIG. 6, the conductor receiving passages 54, 56 have conductor receiving portions 86 and conductor transition or spacing portions 88. The conductor spacing portions 88 extend at an angle relative to a longitudinal axis 52 of the outer shell 34 to receive and space apart the conductors 20, 22 as the conductors 20, 22 exit the cable 12. The conductor receiving portions 86 extend in a direction which is substantially parallel to the longitudinal axis 52 of the outer shell 34.

The positioning of the conductors 20, 22 in the conductor receiving passages 54, 56 maintains the proper positioning and desired spacing of the conductors 20, 22. In the illustrative embodiment, the conductors 20, 22 in the conductor receiving passages 54, 56 extend substantially parallel to each other and in substantially the same plane. As the conductor receiving portion 44 of the outer shell 34 surrounds the conductors 20, 22, as shown in FIG. 5, the outer shell 34 provides protection to the conductors 20, 22, preventing damage to the conductors 20, 22, thereby maintaining the integrity of the conductors 20, 22 and the signal path provided thereby.

As the configuration and positioning of the rib 50 of the second metallic outer shell 34 is precisely controlled during the manufacturing process, the impedance in the conductor receiving portion 44 of the outer shell 34 can be tailored to match or approximately match the impedance of the cable 12, thereby optimizing the performance of the cable 12 and the electrical connector 10. In addition, the impedance in the conductor receiving portion 44 of the outer shell 34 can also be tailored by properly selecting the material used for the rib 50.

The second metallic outer shell 34 is secured to the cable 12 by the third metallic outer shell 31. As shown in FIG. 6, a cable securing portion 46 of the third metallic outer shell 31 is positioned over a portion of the cable 12 and secures the third metallic outer shell 31 to the cable. 12. A second outer shell securing portion 47 is positioned over the conductor receiving portion 44 of the second outer shell 34 and secures the third metallic outer shell 31 to the second metallic outer shell 34. The cable securing portion 46 is then secured, for example by crimping, to retain the second metallic outer shell 34 on the cable 12. However, other known methods of securing the third metallic outer shell 31 to the cable 12 and the second metallic outer shell 34 may be used.

The electrical connector 10, and in particular, the outer shell 34 and the rib 50, provides impedance control and does not damage or rearrange the conductors 20, 22. By properly selecting the material used for the rib 50 and properly determining the spacing between the conductor receiving passages 54, 56, the conductors 20, 22 are properly positioned and the impedance of the connector 10 can be tailored to match or approximately match the impedance of the cable 12, thereby optimizing the performance of the cable 12 and the electrical connector 10.

Referring to FIGS. 7 through 12, a first housing assembly 100 is shown. The housing assembly 100 has a mating end 102 and an oppositely facing conductor receiving end 104. A top wall 106, a bottom wall 108 and side walls 110 extend between the mating end 102 and the conductor receiving end 104. A connector receiving passage 112 extends between the mating end 102 and the conductor receiving end 104. The conductor receiving passage 112 is dimensioned to receive the electrical connector 10 therein. However, the first housing assembly 100 may be configured to receive other electrical connectors or terminals therein.

A latch or latch arm 120 having an engagement projection 122 extends from the top wall 106. In the embodiment shown, the latch 120 is connected to the top wall 106 proximate the mating end 102 and extends toward the conductor receiving end 104. The latch 120 is used to latch and secure the first housing assembly 100 to the second housing assembly 200, as will be more fully described below.

A connector position assurance receiving recess 124 is positioned proximate the top wall 106. Securing projections 126 extend into the connector position assurance receiving recess 124 proximate the conductor receiving end 104. The securing projections 126 are provided on either side of the latch 120.

Figure 13:
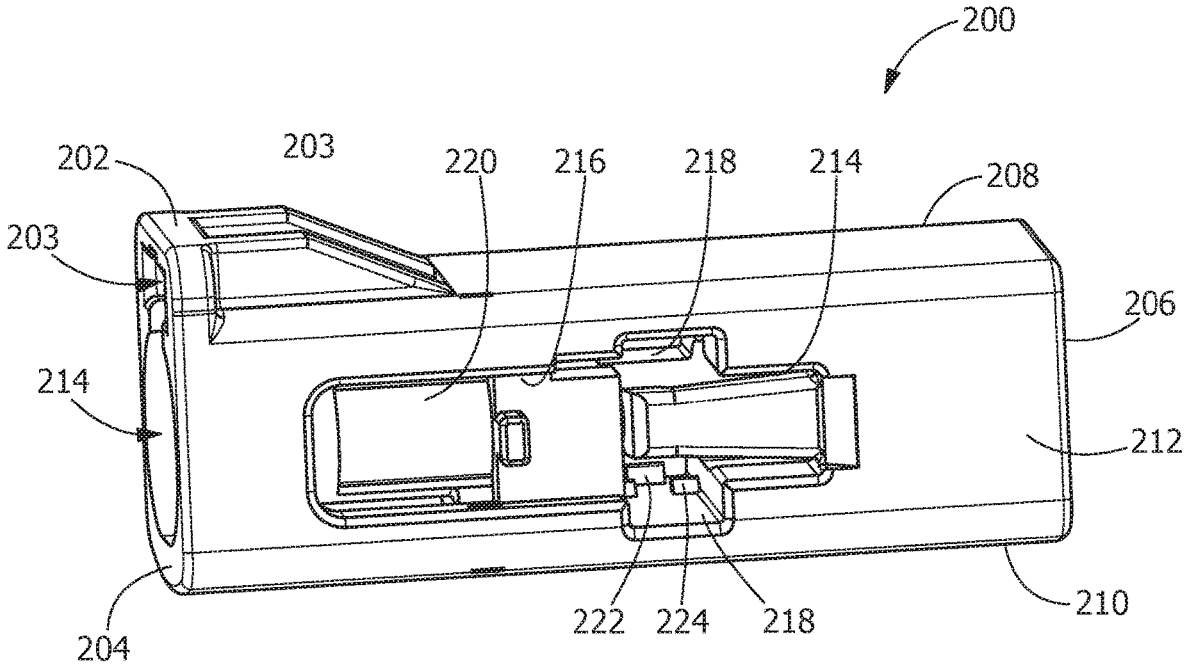
FIG. 13 is a front perspective view of a second housing assembly into which the electrical connector is inserted, a recess is shown for receiving a terminal position assurance member
Figure 14:
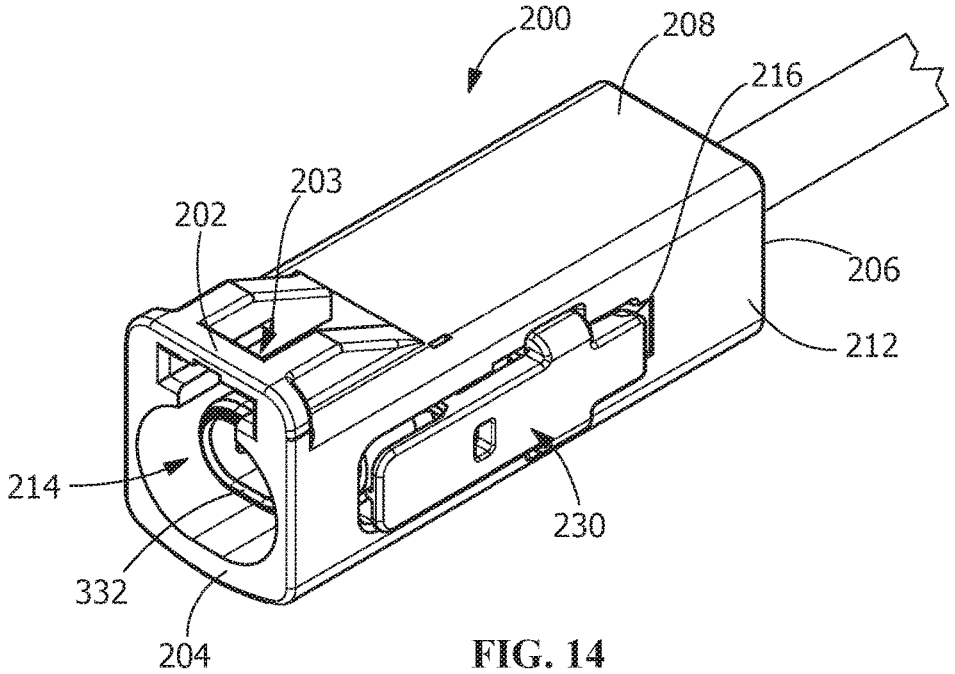
FIG. 14 is a front perspective view of the second housing assembly with a terminal position assurance member is shown in a first or open position.

As shown in FIGS. 13 and 14, the second housing assembly 200 has a complimentary latch engagement section 202 which is positioned to engage the latch arm 120 as the first housing assembly 100 and the second housing assembly 200 are moved from an unmated position to a mated position. A latch-receiving opening 203 is positioned proximate the latch engagement or activation section 202 and is dimensioned to receive the engagement projection 122 when the first housing assembly 100 is fully mated to the second housing assembly 200.

When properly mated together, the engagement projection 122 of the latch 120 cooperates with and is positioned in the latch-receiving opening 203 to secure the second housing assembly 200 with the first housing assembly 100.

Figure 9:
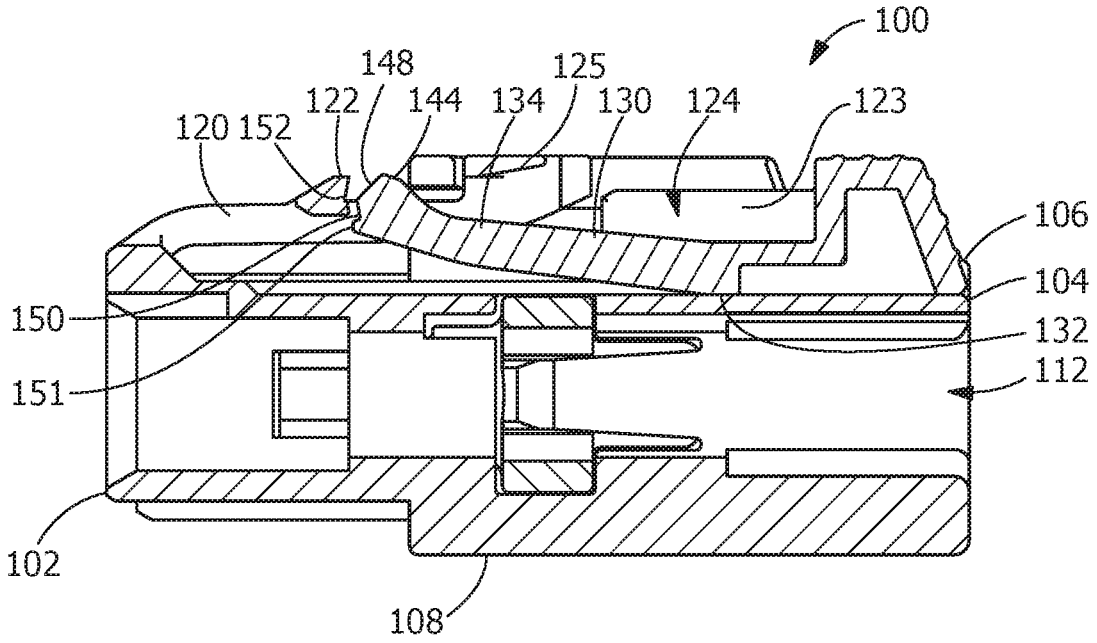
FIG. 9 is a cross-sectional view of the housing of FIG. 7, taken along line 9-9.
Figure 10:
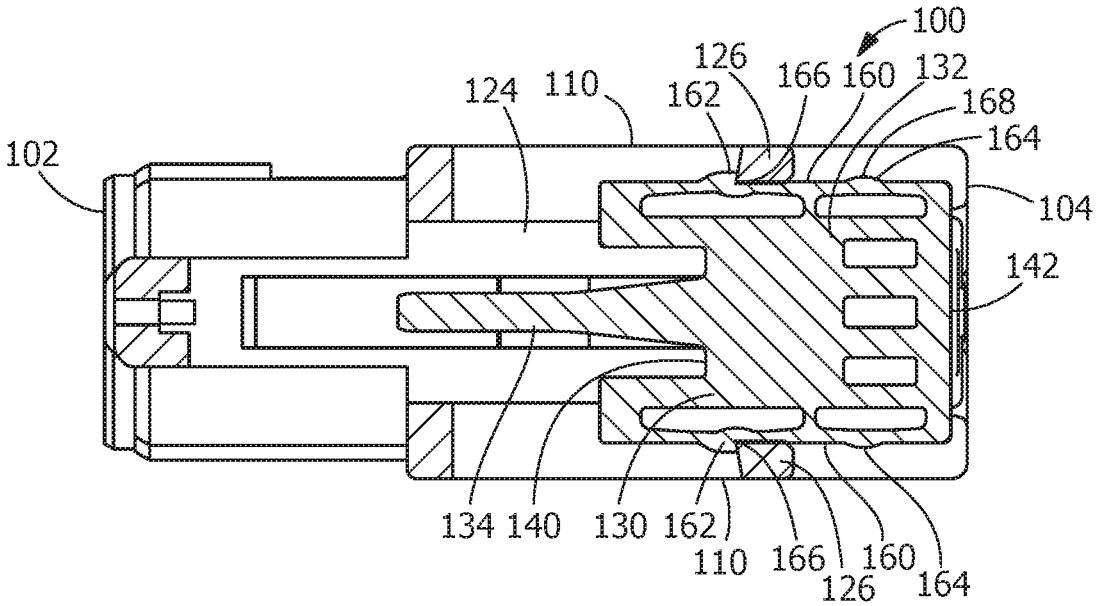
FIG. 10 is a cross-sectional view of the housing of FIG. 7, taken along line 10-10.
Figure 11:
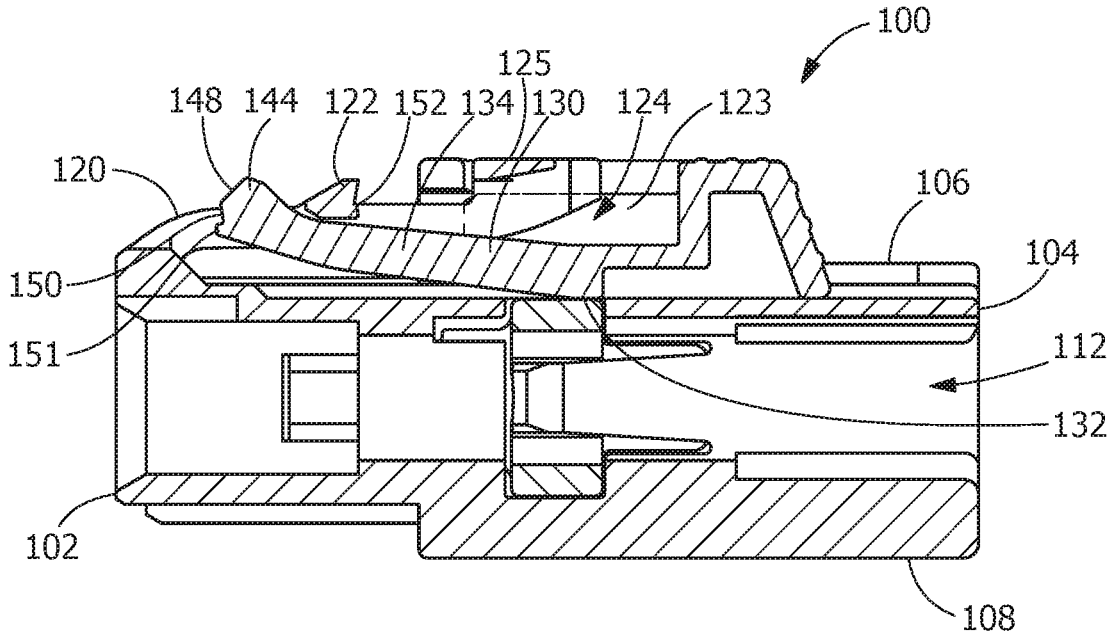
FIG. 11 is a cross-sectional view similar to FIG. 9, except the connector position assurance device is shown in the second or closed position.
Figure 12:
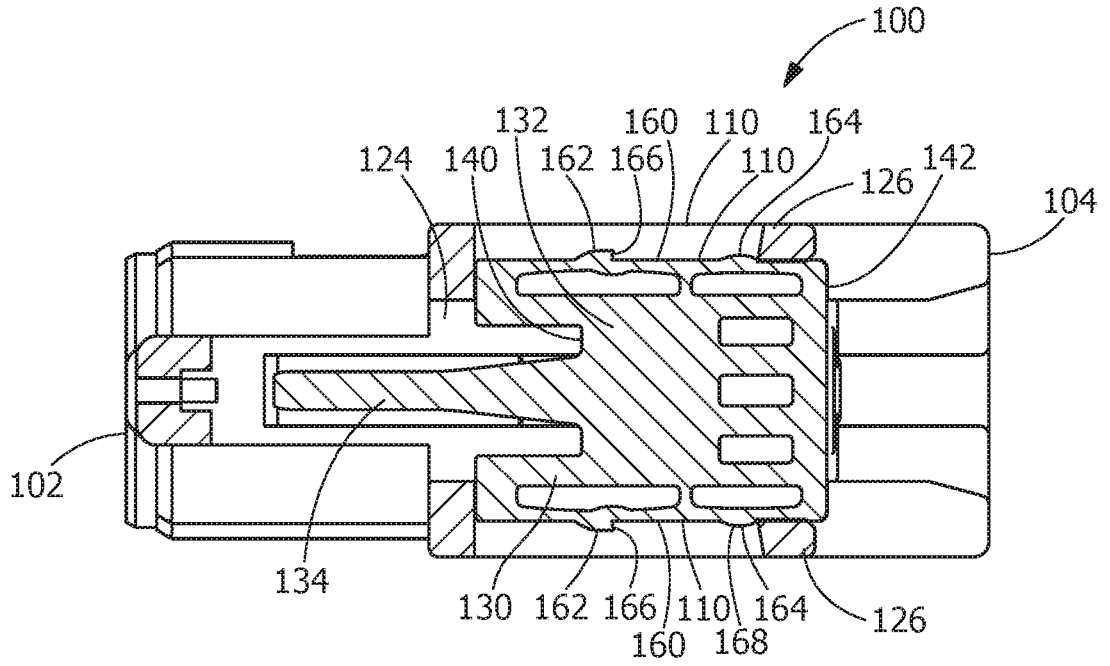
FIG. 12 is a cross-sectional view similar to FIG. 10, except the connector position assurance device is shown in the second or closed position.

A connector position assurance device 130 is maintained in the connector position assurance receiving recess 124 and is movable between a first position or open position, as shown in FIGS. 9 and 10, and a second or fully inserted position, as shown in FIGS. 11 and 12.

The connector position assurance device 130 has a base portion 132 and a resiliently deformable beam 134 which extend from the base portion 132. The base portion 132 has a base front end 140 and a base back end 142. The beam 134 extends from the front end 140 in a direction away from the back end 142. The back end 142 is configured to allow an operator to manually engage or activate the connector position assurance device 130.

As shown in FIGS. 9 and 11, a lockout projection engagement member 144 extends from the beam 134. A cam or sloped surface 148 is provided on the lockout projection engagement member 144. The lockout projection engagement member 144 has an engagement surface 150 which is configured to cooperate with a mating engagement surface 152 of the engagement projection 122 of the latch 120. A shoulder 151 may be provided proximate the engagement surface 150 to facilitate the proper position of the engagement surface 150 relative to the mating engagement surface 152.

As shown in FIGS. 10 and 12, resilient positioning rails 160 extend from the base portion 132. The positioning rails 160 have positioning projections 162, 164. The first positioning projections 162 have locking shoulders 166, while the second positioning projections 164 have a rounded outer surface 168. The positioning projections 162, 164 cooperate with the securing projections 126 to properly position the connector position assurance device 130 in the connector position assurance recess 124 of the first housing assembly 100.

As shown in FIGS. 9 and 10, the first positioning projections 162 cooperates with the securing projections 126 to prevent the removal of the connector position assurance device 130 from connector position assurance receiving recess 124 and to retain the connector position assurance device 130 in the pre-mated, open or first position on the first housing assembly 100 prior to mating with the second housing assembly 200. The longitudinal axis of the positioning rails 160 is substantially parallel to the longitudinal axis of the beam latch 134.

In the pre-mated, open or first position, the latch 120 is in an undeflected position. The connector position assurance device 130 is maintained in the pre-mated, open or first position by the cooperation of the latching projections 162 with securing projections 126 which extend into connector position assurance receiving recess 124.

In the initial position, the movement of the connector position assurance device 130 toward the second position is prohibited unless the first housing assembly 100 is properly mated with the second housing assembly 200. If the first housing assembly 100 is not properly mated with the second housing assembly 200, the engagement surface 150 of the lockout engagement member 144 of the beam 134 of the connector position assurance device 130 remains in engagement with the engagement surface 152 of the engagement projection 122 of the latch 120, thereby preventing the movement of the connector position assurance device 130 to the second position.

As the first housing assembly 100 is mated with the second housing assembly 200, the latch engagement section 202 of the second housing assembly 200 engages the engagement projection 122 of the latch 120, forcing the engagement projection 122 of the latch 120 to move toward the top wall 106.

As insertion continues, the latch engagement section 202 of the second housing assembly 200 engages the cam or sloped surface 148, forcing the lockout projection engagement member 144 and the beam 134 toward the top wall 106. This causes the engagement surface 150 of the lockout engagement member 144 of the beam 134 of the connector position assurance device 120 to be removed from the engagement surface 152 of the engagement projection 122 of the latch 120, thereby allowing the latch 120 to move relative to the beam 134 of the connector position assurance device 120.

Continued insertion forces the latch engagement section 202 to move past the engagement projection 122 of the latch 120, allowing the latch 120 to return to an unstressed position. With the latch 120 returned to the unstressed position and the lockout projection engagement member 144 and the beam 134 moved toward the top wall 106, the connector position assurance device 130 is pushed, in a direction toward the mating end 102 of the first housing assembly 100 by the operator, to the mated, second or inserted position (FIGS. 11 and 12). The second positioning projections 164 cooperates with the securing projections 126 to retain the connector position assurance device 130 in the second position.

If the first housing assembly 100 and the second housing assembly 200 are not fully mated, the lockout projection engagement member 144 and the beam 134 will not be fully depressed, thereby preventing the movement of the resiliently deformable beam 134 and the lockout projection engagement member 144. Consequently, continued insertion of the connector position assurance device 130 will be prevented by the cooperation of the engagement surface 150 of the lockout projection engagement members 144 with the mating engagement surface 12 of the engagement projection 122.

With the lockout projection engagement member 144 and the beam 134 properly deflected, the movement of the connector position assurance device 130 from the first position (FIGS. 9 and 10) to the second position (FIGS. 11 and 12) can continue. In the second position, the lockout projection engagement member 144 is moved toward the mating end 102 of the first housing assembly 100, beyond the engagement projection 122 into the latch-receiving opening 203 of the second housing assembly 200, allowing lockout projection engagement member 144 and the resiliently deformable beam 134 to return toward an unstressed position, positioning the connector position assurance device 130 in the mated, closed or second position.

The connector position assurance device 130 is maintained in the mated, closed or second position by the cooperation of the second positioning projections 164 with the securing projections 126.

In this fully inserted position, rail surfaces 123 of the connector position assurance device 130 is moved beneath a release lever 125 which is provided at the end of the latch 120 (as indicated by the lines shown in phantom in FIG. 11). In this position, the rail surfaces 123 prevent the downward movement of the release lever 123 and the latch 120, thereby blocking the activation or movement of the latch 120, preventing the unwanted or inadvertent unmating of the first housing assembly 100 from the second housing assembly 200. Additionally, in the fully inserted position, the latch 134 of the connector position assurance device 130 is positioned beneath the engagement projection 122 of the latch 120 to block the activation or movement of the latch 120, also preventing the unwanted or inadvertent unmating of the first housing assembly 100 from the second housing assembly 200.

Figure 15:
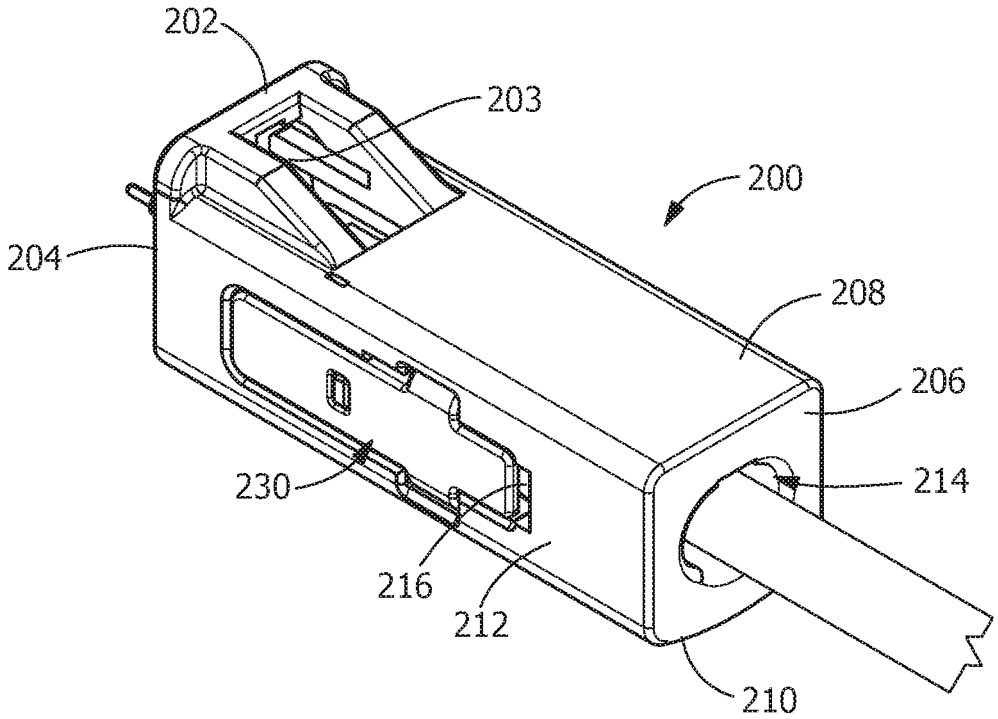
FIG. 15 is a back perspective view of the second housing assembly with the terminal position member shown in the second or closed position

As shown in FIGS. 13 through 15, the second housing assembly 200 has the latch engagement section 202 for cooperating with the first housing assembly 100, as previously described. The second housing assembly 200 has a mating end 204 and an oppositely facing conductor receiving end 206. A top wall 208, a bottom wall 210 and side walls 212 extend between the mating end 204 and the conductor receiving end 206. A connector receiving passage 214 extends between the mating end 204 and the conductor receiving end 206. The conductor receiving passage 214 is dimensioned to receive the electrical connector 300 therein. However, the second housing assembly 200 may be configured to receive other electrical connectors or terminals therein.

Figure 20:
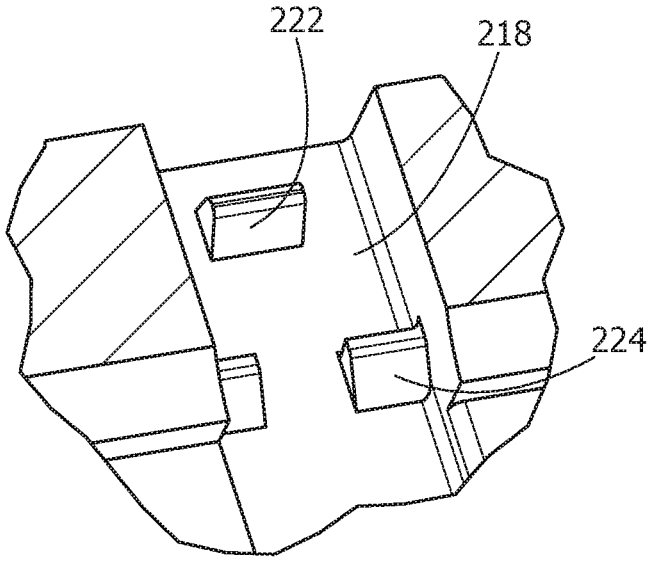
FIG. 20 is an enlarged perspective view of a portion of a terminal position assurance receiving recess of the second housing assembly.

A terminal position assurance receiving recess 216 is provided in a respective side wall 212 of the second housing assembly 200. As shown in FIG. 13, the recess 216 has arm receiving recesses 218 which extend from the recess 216 toward the opposed side wall 212. The arm receiving recesses 218 intersect with the conductor receiving passage 214. A locating member receiving recess 220 extends from the recess 216 to the conductor receiving passage 214. The locating member receiving recess 220 is provided proximate the mating end 204. As shown in FIG. 20, the arm receiving recesses 218 have first projections 222 and second projections 224 which extends into the arm receiving recesses 218.

Figure 16:
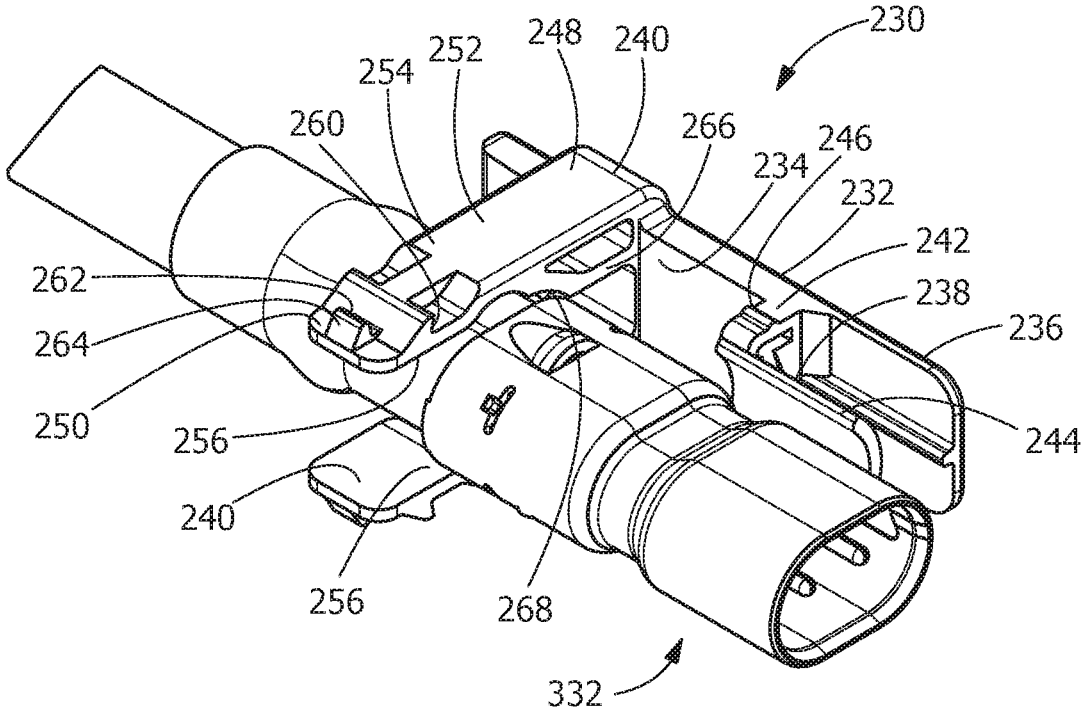
FIG. 16 is a perspective of the connector assembly and the terminal position assurance member of FIG. 14 with the housing removed.
Figure 18:
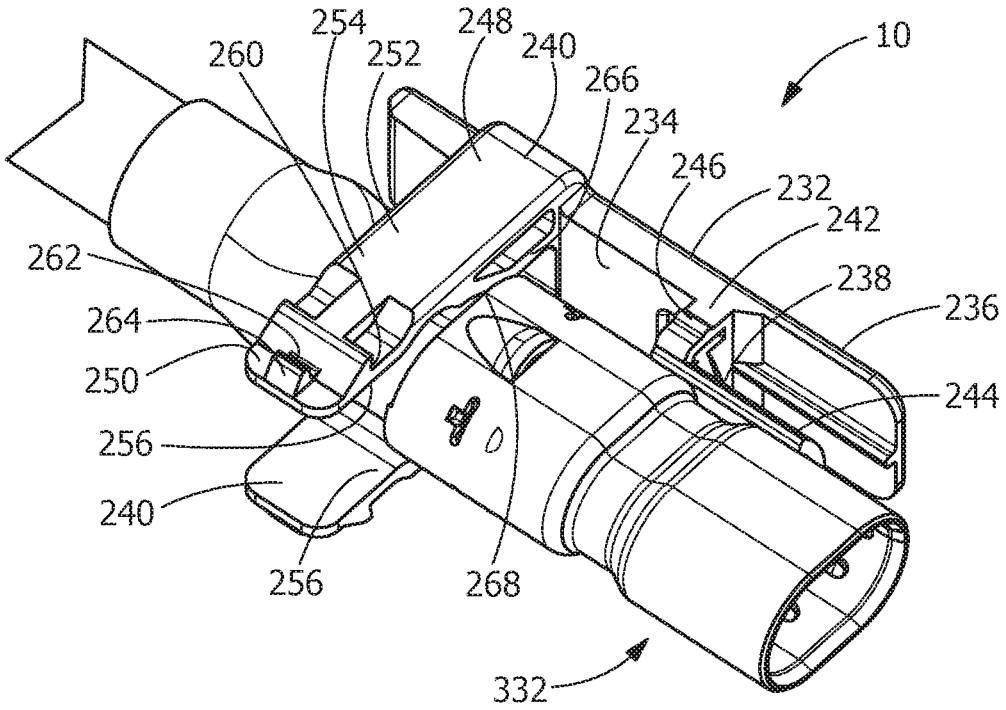
FIG. 18 is a perspective of the connector assembly and the terminal position assurance member of FIG. 15 with the housing removed.

As shown in FIGS. 16 and 18, a terminal position assurance member 230 has a base 232 with a first surface 234 and an oppositely facing second surface 236. A first terminal engagement section 238 and second terminal engagement sections or arms 240 extend from the base 232 in a direction away from the first surface 234. A similar terminal position assurance recess and terminal position assurance member may also be provided in the first housing assembly 100.

The first terminal engagement section 238 has an extension arm 242 and a terminal positioning surface 244 which is provided at the end of the extension arm 242. Location projections 246 are provided on the extension arm 242.

Two second terminal engagement arms 240 from either side of the base 232 of the terminal position assurance member 230. The second terminal engagement arms 240 have fixed ends 248 which are integrally attached to the base 232, free ends 250 which are spaced from the fixed ends 238 and mid sections 252 which extend between the fixed ends 248 and the free ends 250. Each of the second terminal engagement arms 240 have a first surface 254 and an oppositely facing second surface 256. A second surface 256 of a first of the second terminal engagement arms 240 faces the second surface 256 of a second of the second terminal engagement arms 240. The second terminal engagement arms 240 have first latching shoulders 260, second latching shoulders 262 and third latching shoulders 264 which are provided on the first surfaces 254.

Terminal locking projections 266 extend from the mid sections 252 of the second terminal engagement arms 240 to the first surfaces 234 of the base 232. The terminal locking projections 266 have terminal engagement surfaces 268 provided thereon. Each of the terminal locking projections 266 has a curved surface which faces the second surface 256 of an opposed second terminal engagement arm 240.

Figure 17:
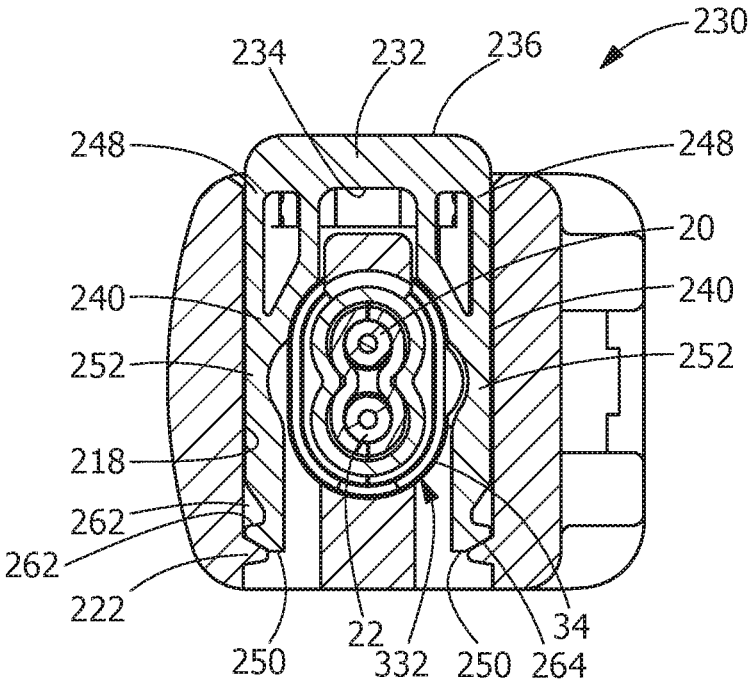
FIG. 17 is a cross-sectional view of the housing assembly of FIG. 14, taken along line 17-17.

Referring to FIGS. 14, 16 and 17, the terminal position assurance member 230 is shown a first position or open position. In this position, the second latching shoulders 262 engage the first projections 222 of the arm receiving recesses 218 to retain the terminal position assurance member 230 in the first or open position. In addition, the location projections 246 on the extension arm 242 engage the side wall 212 of the second housing assembly 200 to retain the terminal position assurance member 230 in the first position or open position. In the first position, the terminal engagement surfaces 268 are positioned out of the conductor receiving passages 214, thereby allowing the connector 300 to be inserted into the conductor receiving passages 214 without interference from the terminal engagement surfaces 268.

Figure 19:
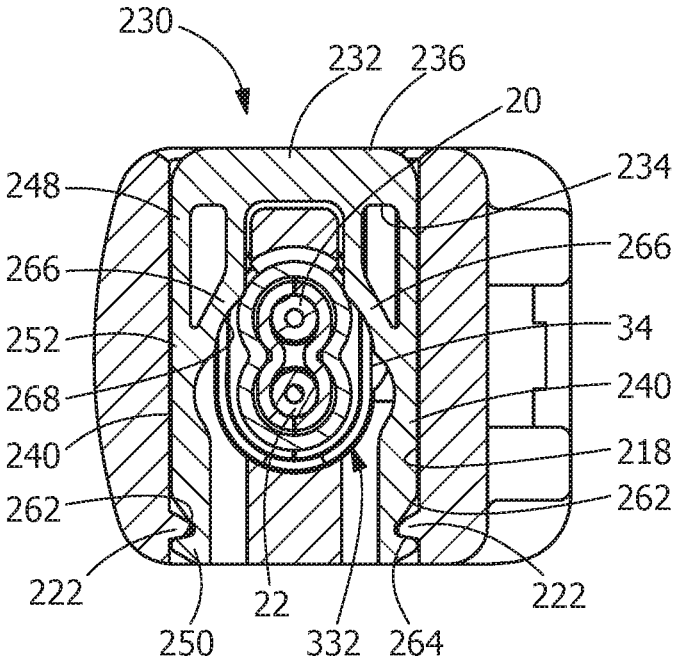
FIG. 19 is a cross-sectional view of the housing assembly of FIG. 15, taken along line 19-19.

With the connector 300 properly inserted into the conductor receiving passages 214, an operator forces the terminal position assurance member 230 to a second or inserted position, as shown in FIGS. 15, 18 and 19. As this occurs, the third latching shoulders 264 are forced past the first projections 222 of the arm receiving recesses 218 to allow the terminal position assurance member 230 to move toward the second position.

In the second position, as shown in FIG. 19, the first latching shoulders 260 engage the second projections 224 (not shown because of where the cross-section is taken) and the second latching shoulder 262 engage the first projections 222. The cooperation of the latching shoulders with the latching projections retains the terminal position assurance member 230 in the second position. In the second position, the terminal engagement surfaces 268 are positioned in the conductor receiving passages 214 and engage a back surface of the metallic outer shell 332 to prevent the removal of the connector 300 from the conductor receiving passages 214. In the second position, the terminal position surface 244 of the first terminal engagement section 232 also engages the metallic outer shell 332 (as shown in FIG. 18) to further support and stabilize the connector 300 in the conductor receiving passage 214.

If the connector 300 is not properly seated in the conductor receiving passage 214, the terminal position assurance member 230 is prevented from moving to the second position. If the connector 300 is not properly seated in the conductor receiving passage 214, the terminal engagement surfaces 268 of the terminal locking projections 266 of the terminal engagement arms 240 will engage the outer shell 332 of the connector 300 preventing the movement of the terminal position assurance member 230 to the second, fully inserted position. If the terminal position assurance member 230 is not properly positioned in the second position, the terminal position surface 244 of the first terminal engagement section 232 of the terminal position assurance member 230 will engage the mating end 102 of the first housing assembly 100, thereby preventing the first housing assembly 100 for being mated with the second housing assembly 200.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector assembly which controls impedance, the connector assembly comprising:

a cable having conductors;

a first metallic outer shell;

a second metallic outer shell having a conductor receiving portion, a rib formed in the conductor receiving portion, the rib extending in a direction which is parallel to a longitudinal axis of the second metallic outer shell, the rib divides the conductor receiving portion into two conductor receiving passages having conductor receiving portions and conductor transition portions, the conductor transition portions extending at angles relative to a longitudinal axis of the second metallic shell, the conductor receiving portions extending in a direction substantially parallel to the longitudinal axis of the second metallic shell;

wherein the conductor receiving passages interact with the conductors to match the impedance of the conductors in the second metallic outer shell with the impedance of the cable.

2. The connector assembly as recited in claim 1, wherein the connector assembly has at least one terminal, the at least one terminal comprising;

a conductor receiving section;

a mating terminal receiving section, the mating terminal receiving section having a lead-in portion and securing projections, at least one longitudinally extending opening positioned about the circumference of the mating terminal receiving section, the at least one longitudinally extending opening reduces the cross section of the terminal, the least one longitudinally extending opening configured to reduce inductive coupling to an adjacent terminal;

wherein the least one longitudinally extending opening provides impedance tuning to allow for a defined diameter of the terminal to be maintained without an impedance drop because of the close proximity of the terminal to the adjacent terminal.

3. The connector assembly as recited in claim 1, wherein the first metallic outer shell has a stamped and formed recess which extends about the circumference of the first metallic outer shell, the recess provides controlled impedance of the first metallic outer shell in the area of the recess.

4. The connector assembly as recited in claim 3, wherein the recess has a bottom wall and transition walls which extend from an outside surface of the first metallic outer shell to the bottom wall of the recess.

5. A connector housing assembly comprising:

a mating end and an oppositely facing conductor receiving end, a top wall, a bottom wall and side walls extending between the mating end and the conductor receiving end, a connector receiving passage extending between the mating end and the conductor receiving end;

an impedance controlled connector assembly positioned in the connector receiving passage, the connector assembly having a first metallic outer shell and a second metallic outer shell, the first metallic outer shell has a stamped and formed recess which extends about the circumference of the first metallic outer shell, the recess provides controlled impedance of the first metallic outer shell in the area of the recess;

a terminal position assurance receiving recess extending from a side wall;

a terminal position assurance device positioned in the terminal position assurance receiving recess, the terminal position assurance device having a base with a first surface and an oppositely facing second surface, a first terminal engagement section and second terminal engagement arms extending from the first surface in a direction away from the second surface, the first terminal engagement section has an extension arm and a terminal positioning surface which is provided at the end of the extension arm, the second terminal engagement arms have latching shoulders, terminal locking projections are provided on the second terminal engagement arms, the terminal locking projections have terminal engagement surfaces provided thereon.

6. The connector housing assembly as recited in claim 5, wherein terminal position assurance receiving recess has arm receiving recesses which extend from the terminal position assurance receiving recess toward an opposed side wall, the arm receiving recesses intersect with the conductor receiving passage, a locating member receiving recess extends from the terminal position assurance receiving recess to the conductor receiving passage, the locating member receiving recess is provided proximate the mating end, the arm receiving recesses have first projections and second projections which extends into the arm receiving recesses.

7. The connector housing assembly as recited in claim 5, wherein the connector assembly has a conductor receiving portion, a rib is formed in the conductor receiving portion, the rib extends in a direction which is parallel to a longitudinal axis of the second metallic outer shell.

* * * * *